United States Patent [19]

Terral

[11] 4,197,909

[45] Apr. 15, 1980

[54] PROTECTOR FOR A DEFLECTOR GUIDE OF A MANDREL

[75] Inventor: Ben D. Terral, Houston, Tex.

[73] Assignee: Camco, Incorporated, Houston, Tex.

[21] Appl. No.: 969,764

[22] Filed: Dec. 15, 1978

[51] Int. Cl.[2] ..... E21B 7/06

[52] U.S. Cl. ..... 166/117.5

[58] Field of Search ..... 166/117.5; 175/78

[56] References Cited

U.S. PATENT DOCUMENTS

| | | | |
|---|---|---|---|
| 2,582,403 | 1/1952 | Yancey et al. | 166/117.5 |
| 3,268,006 | 8/1966 | Hayes | 166/117.5 |
| 3,741,299 | 6/1973 | Terral | 166/117.5 |
| 3,891,032 | 6/1975 | Tausch et al. | 166/117.5 |
| 4,106,563 | 8/1978 | Gatlin et al. | 166/117.5 |
| 4,106,564 | 8/1978 | Tausch | 166/117.5 |

*Primary Examiner*—Ernest R. Purser

*Assistant Examiner*—Nick A. Nichols, Jr.

*Attorney, Agent, or Firm*—Fulbright & Jaworski

[57] ABSTRACT

A protector for preventing tools from becoming engaged between an internally-mounted deflector guide and the inside of the body of a side-pocket mandrel. The protector includes a protrusion connected to the body adjacent to and above the deflector guide which extends into the interior of the body for blocking the space between the deflector guide and the body thereby preventing well tools from becoming stuck. The protrusion may include one or more arcuate members plug welded into the body. In addition, the protrusion may be made intergal with or connected to the upper end of the deflector guide. Preferably, at least the outer and upper edges of the protrusion are beveled outwardly towards the inside of the mandrel body for eliminating engaging shoulders. In other form, the protrusion may be formed of indentations made in the wall of the body.

6 Claims, 7 Drawing Figures

Fig. 5
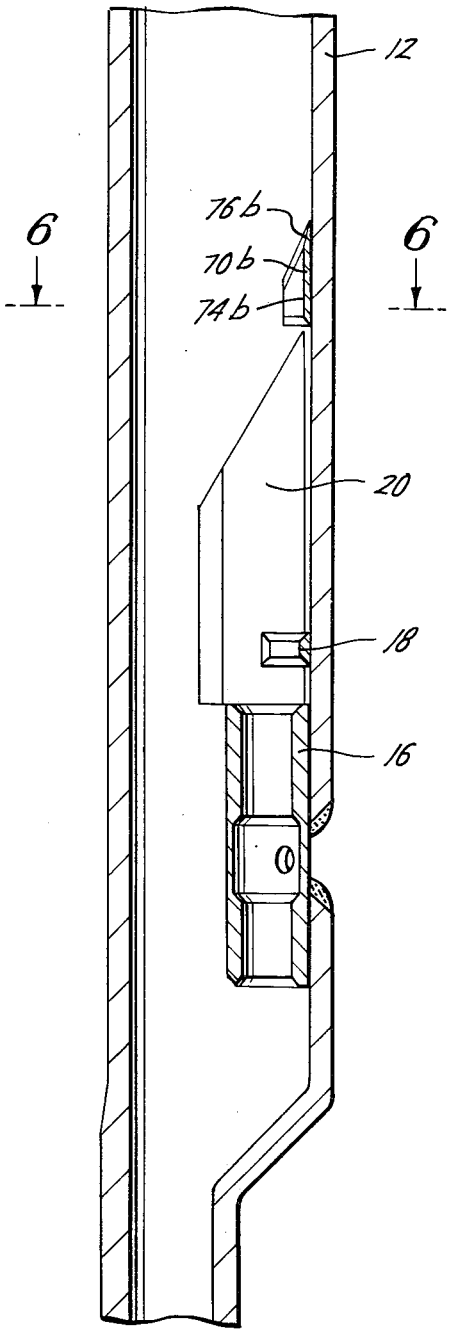
Fig. 6
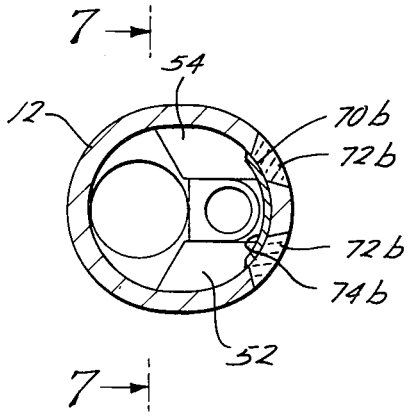
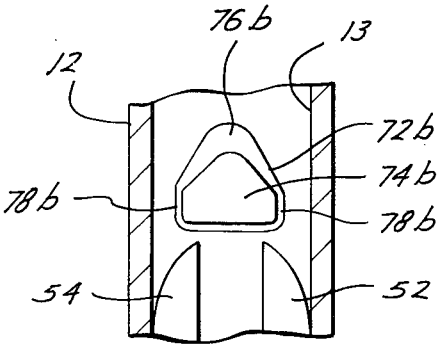
Fig. 7

PROTECTOR FOR A DEFLECTOR GUIDE OF A MANDREL

BACKGROUND OF INVENTION

Generally, it is old to provide a deflector guide in a side-pocket mandrel which serves the function of guiding flow-control devices into the side-pocket, as well as deflecting well tools away from the side-pocket and into the open bore of the mandrel such as shown in U.S. Pat. No. 3,741,299. The type of deflector guides which are formed as part of the mandrel body have been effective in both guiding side-pocket valves into the side-pocket and deflecting other well tools into the open bore. However, it is advantageous to utilize an internally-mounted deflector guide as disclosed in U.S. Pat. No. 4,106,563, because of its ease of manufacturing and cost. The internally-mounted deflector guide is secured to the pocket and is directed upwardly against the inside wall of the inside of the mandrel. Frequently, a space exists between the upper pointed end of the deflector guide and the inside of the body of the mandrel in which various well tools, for example a parrafin cutter, can become caught instead of being deflected.

The present invention is directed to a protector to prevent the pointed upper ends of the deflector guide from being caught on or engaging well tools even in the event that the protector guide is out of contact with the interior wall of the mandrel body.

SUMMARY

The present invention is directed to an improvement in a side-pocket mandrel having an internally-mounted deflector guide in which a protector is provided for preventing tools from becoming engaged between the deflector guide and the inside of the mandrel body.

A further object of the present invention is the provision of a deflector guide which is a protrustion connected to the body adjacent to and above the deflector guide and extending into the interior of the body for preventing tools from becoming engaged between the deflector guide and the inside of the body.

A further object of the present invention is the provision of a protector protrusion which includes one or arcuate members which are plug welded into the body. In addition, the protrusion may be connected to the upper end of the deflector guide.

Yet a still further object is the provision of a protrusion in which the outer and upper edges of the protrusion are beveled outwardly towards the inside of the body for avoiding shoulders on which well tools may catch.

A still further object is the provision wherein the protrusion includes one or more indentations in the wall of the body.

Other and further objects, features and advantages will be apparent from the following description of presently preferred embodiments of the inventions, given for the purpose of disclosure and taken in conjunction with the accompanying drawings.

BRIEF DESCRIPTION OF THE DRAWINGS

Fig. 5 is a fragmentary elevational view, in cross-section of a mandrel with a still further embodiment of the present invention, FIG. 6 is a cross-sectional view taken along the line 6—6 of FIG. 5, and FIG. 7 is a cross-sectional view taken along the line 7—7 of FIG. 6.

DESCRIPTION OF THE PREFERRED EMBODIMENTS

Figure 1:
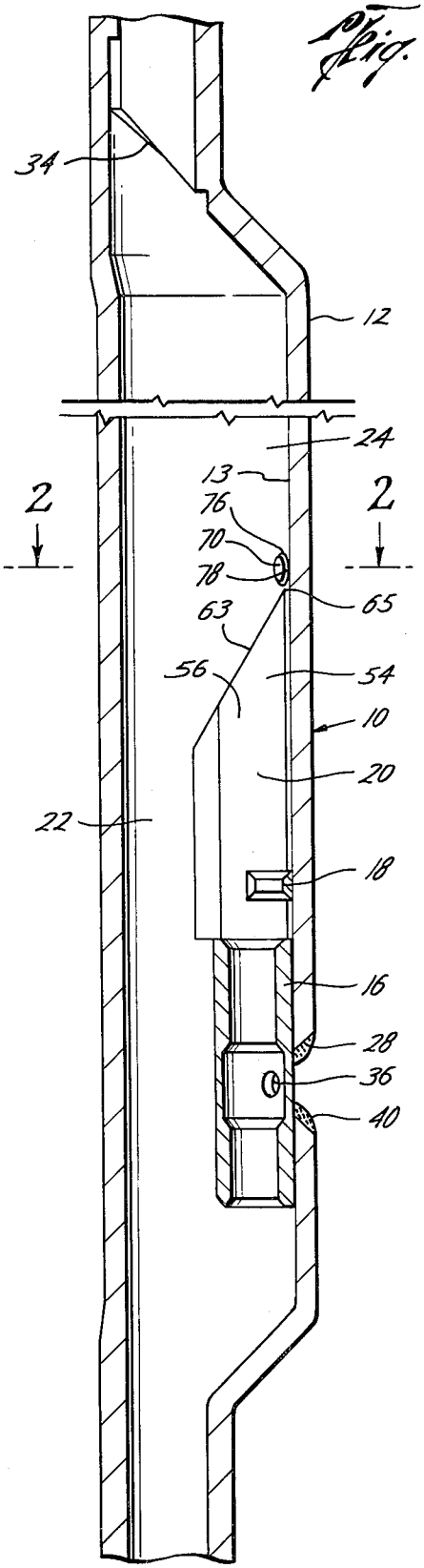
FIG. 1 is a fragmentary elevational view, in cross-section, of a mandrel utilizing the present invention.

Referring now to the drawings, and particularly to FIG. 1, the reference numeral 10 generally indicates a mandrel which includes a body 12, an orienting surface 34, a side-pocket 16, a locking lug or shoulder 18, and a deflector guide 20.

The body 12 includes an open bore 22 extending therethrough for alignment with a well tubing into which the mandrel 10 is inserted and also includes an offset bore 24. The body further includes an opening 28 in communication with the offset bore 24 and the side-pocket 16. The pocket 16 is positioned in the open bore 24, adjacent to body opening 28, and includes one or more ports 36 for emitting or expelling fluids between the interior and exterior of the mandrel 10 as is conventional. The pocket 16 is positioned inside the mandrel body 12 and is secured in place adjacent to the opening 28 by suitable welds 40 around the periphery of the opening 28.

The deflector guide 20 protects flow-control devices seated in the pocket 16 from damage by open bore well tools moving through the open bore 22, prevents the open bore tools from catching on the flow-control devices, and guides the oriented flow-control devices towards the side-pocket 16. The deflector guide 20 is positioned in the offset bore 24 and its axis is aligned with the axis of the offset pocket 16. Preferably, the deflector guide 20 includes a pair of rails 52 and 54 (FIG. 2) forming a guide path 56 there between. The top 63 of the deflector guide 20 extends upwardly and outwardly from the open bore 22 towards the inside wall of the body 12 for providing a deflection surface which prevents open bore tools from catching on the guide 20 or on any flow-control device seated in the pocket 16. The deflector guide 20 and the side-pocket 16 are secured together for insuring alignment therebetween and for securing the deflector guide in place by being supported by the welds 40 and by spot welding the rails 52 and 54 to the interior of the body 12. The above description of an internally-mounted type deflector guide is generally described in U.S. Pat. No. 4,106,563.

However, internally-mounted deflector guides 20, unlike the integrally-mounted deflector guides, may have the pointed upper ends 65 spaced a slight distance from the interior wall 13 of the mandrel body 12 due to manufacturing tolerances. This space or crevice is subject to undesirably catching well tools moving down the open bore 22, particularly if the mandrel 12 is in a slanted well bore with the pocket 26 on the low side. For example, well tools such as a paraffin scraper with its chisel-like periphery could become struck between a deflector guide 20 and the inside 13 of the body 12.

The present invention is directed to providing a protector for preventing tools from becoming engaged in the crevice, if one exists, between the deflector guide 20 and the interior wall 13.

Figure 2:
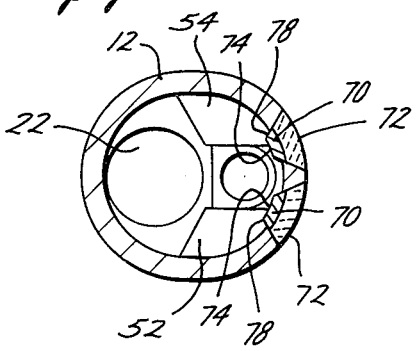
FIG. 2 is a cross-sectional view taken along the line 2—2 of FIG. 1.

Referring now to FIGS. 1 and 2, the protector, generally indicated by the reference numeral 70, may include one or more protrusions connected to the body 12 adjacent to but above the deflector guide 20 and extending into the interior of the body for preventing well tools from becoming engaged between the deflector guide 20 and the inside 13 of the body 12. FIG. 2 shows the use of two protectors 70, each of which is positioned above the upper pointed ends 65 of the rails 52 and 54 and which are secured in place by being plug welded by welds 72. Preferably, the protrusions 70 protrude into the interior of the body 12 such as approximately 3/16ths of an inch. It is also preferable that the protectors 70 include an arcuate face 74 and that the upper edge 76 and side edges 78 are beveled outwardly towards the inside 13 of the wall 12, thereby eliminating any shoulders which may act to catch well tools.

Figure 4:
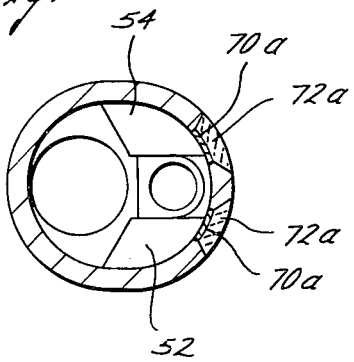
FIG. 4 is a cross-sectional view of a further embodiment of the present invention.

Now referring to FIG. 4, a further embodiment is shown in which the protectors **70*a* are connected to the rails 52 and 54 at their upper ends and are plug welded by weld 72*a*, thereby eliminating the possibility of any space being between the uppermost points 65 of the discriminator 20 and the interior wall 13 of the body 12**.

Referring now to FIGS. 5, 6 and 7, a further embodiment **70*b* is shown, which is a single protector plate mounted and plug welded by welds 72*b* in a position immediately above the upper ends of the rails 52 and 54, thereby disallowing service tools from contacting the upper ends of the deflector guide 20. The plate 70*b* includes an arcuate face 74*b* and includes an upper beveled surface 76*b* and beveled edges 78*b* which are beveled outwardly towards the inside 13 of the body 12. The protector 76*b*** may be extended upwardly as far as desired.

Figure 3:
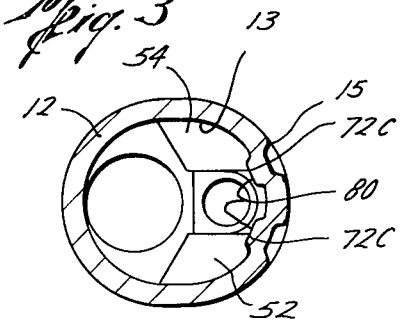
FIG. 3 is a cross-sectional view of another embodiment of the present invention.

Referring now to FIG. 3, a still further embodiment is shown, which is the preferred embodiment, is the provision of one or more protrusions **72*c*, preferably one above the upper end 65 of each of the rails 52 and 54, which are formed by indentations in the outer surface 15 of the body 12 by heating the body 12 to a high enough temperature whereby the indentations 72*c* may be formed. The protrusions 72*c*, as with the other embodiments, are in the body 12 adjacent to and above the deflector guide 20 and extend into the interior of the body 12. The interior surface 80 of the protrusions 72*c* will be generally convex without any engaging edges and thereby serve to protect any space existing between the rails 52 and 54 and the interior 13 of the body 12**.

The present invention, therefore, is well adapted to carry out the objects and obtain the ends and advantages mentioned as well as others inherent therein. While presently preferred embodiments of the invention have been given for the purpose of disclosure, numerous changes in the details of construction and arrangement of parts, may be made with or are encompassed by the spirit of the invention and the scope of the attendant claims.

What is claimed is:

1. In a mandrel for use in a well tubing having a body with an open bore extending therethrough and an offset bore adjacent the open bore, an opening through the body in communication with the offset bore, a valve pocket positioned inside the body in the offset bore beside the body opening and secured to the body, a deflector guide connected to the pocket and extending upwardly and outwardly from the open bore for providing a deflector guide, and a locking lug positioned above the pocket, the improvement in a protector for preventing tools from becoming engaged between the deflector guide and the inside of the body comprising, a protrusion connected to the body at a position adjacent to, aligned with, and above the deflector guide and extending into the interior of the body for preventing tools from becoming engaged between the top of the deflector guide and the inside of the body.

2. The apparatus of claim 1 wherein the protrusion includes one or more arcuate members plug welded into the body.

3. The apparatus of claim 2 wherein the protrusion is connected to the upper end of the deflector guide.

4. The apparatus of claim 2 wherein the outer and upper edges of said protrusion are bevelled outwardly towards the inside wall of the body.

5. In a mandrel for use in a well tubing having a body with an open bore extending therethrough and an offset bore adjacent the open bore, an opening through the body in communication with the offset bore, a valve pocket positioned inside the body in the offset bore beside the body opening and secured to the body, a deflector guide connected to the pocket and extending upwardly and outwardly from the open bore for providing a deflector guide, and a locking lug positioned above the pocket, the improvement in a protector for preventing tools from becoming egaged between the deflector guide and the inside the body comprising, a protrusion of one or more indentations in the wall of the body at a position adjacent to, aligned with, and above the deflector guide and extending into the interior of the body for preventing tools from becoming engaged between the top of the deflector guide and the inside of the body.

6. The apparatus of claim 5 wherein the indentations have a convex surface on the interior of the body.

* * * * *